US007303816B2

(12) United States Patent
Nakamura

(10) Patent No.: US 7,303,816 B2
(45) Date of Patent: Dec. 4, 2007

(54) PROCESS AND APPARATUS FOR MANUFACTURING FIBER AND FIBER SHEET CARRYING SOLID PARTICLES AND FIBER AND FIBER SHEET CARRYING SOLID PARTICLES

(75) Inventor: Tatsuo Nakamura, Ibaraki (JP)

(73) Assignee: Japan Vilene Company, Ltd., Tokyo (JP)

( * ) Notice: Subject to any disclaimer, the term of this patent is extended or adjusted under 35 U.S.C. 154(b) by 0 days.

(21) Appl. No.: 11/039,913

(22) Filed: Jan. 24, 2005

(65) Prior Publication Data

US 2005/0123731 A1 Jun. 9, 2005

Related U.S. Application Data

(62) Division of application No. 10/234,336, filed on Sep. 5, 2002, now Pat. No. 6,863,921.

(30) Foreign Application Priority Data

Sep. 6, 2001 (JP) ..... 2001-269674
Mar. 25, 2002 (JP) ..... 2002-083614

(51) Int. Cl.
*D02G 3/00* (2006.01)
*B32B 5/16* (2006.01)

(52) U.S. Cl. ..... 428/372; 428/375; 428/389; 428/323

(58) Field of Classification Search ..... 428/375, 428/372, 389
See application file for complete search history.

(56) References Cited

U.S. PATENT DOCUMENTS 2,873,219 A 2/1959 Brennan
3,958,758 A 5/1976 Piorkowski et al.
3,998,988 A * 12/1976 Shimomai et al. ..... 428/400
4,289,807 A 9/1981 Christensen et al.
4,543,274 A 9/1985 Mulder
5,134,959 A 8/1992 Woodmansee et al.
5,486,410 A 1/1996 Groeger et al.
5,611,885 A 3/1997 Hansen et al.
5,612,081 A 3/1997 Orr et al.

FOREIGN PATENT DOCUMENTS

JP 48-64300 9/1973
JP 60-2131 1/1985
JP 06 341044 A 12/1994

* cited by examiner

*Primary Examiner*—Jill Gray
(74) *Attorney, Agent, or Firm*—Sughrue Mion Pllc.

(57) ABSTRACT

Disclosed is a process for manufacturing a fiber having at least a surface comprised mainly of a thermoplastic resin and carrying solid particles affixed to the surface, comprising the steps of:

heating the solid particles having a melting point or a decomposition point higher than a melting point of the thermoplastic resin, to a temperature higher than the melting point of the thermoplastic resin, bringing the heated solid particles into contact with the fiber while maintaining the temperature of the heated solid particles higher than the melting point of the thermoplastic resin to bond the solid particles to a fiber surface by fusing the fiber surface, and cooling the fused fiber carrying the solid particle to affix the solid particles to the fiber surface. Further, an apparatus of manufacturing the same, and a fiber having at least a surface comprised mainly of a thermoplastic resin and carrying solid particles affixed to the surface are also disclosed.

18 Claims, 3 Drawing Sheets

PROCESS AND APPARATUS FOR MANUFACTURING FIBER AND FIBER SHEET CARRYING SOLID PARTICLES AND FIBER AND FIBER SHEET CARRYING SOLID PARTICLES

This is a divisional of application Ser. No. 10/234,336 filed Sep. 5, 2002 now U.S. Pat. No. 6,863,921, the disclosure of which is incorporated herein by reference.

BACKGROUND OF THE INVENTION

1. Field of the Invention

The present invention relates to a process and an apparatus for manufacturing a fiber carrying solid particles and a fiber sheet carrying solid particles, and a fiber carrying solid particles and a fiber sheet carrying solid particles.

2. Description of the Related Art

As a method for bonding solid particles to a fiber surface, for example, Japanese Unexamined Patent Publication (Kokai) No. 6-341044 disclosure a nonwoven fabric prepared by binding fibers to each other by a binder (a binder solution, dispersion, or emulsion) and at the same time affixing functional powders to the fiber surface by the binder. This publication also discloses a nonwoven fabric prepared as described below. That is, an aggregate of core-sheath type hot-melt fibers consisting of a resin having a high melting point as a core component and a binder resin having a low melting point as a sheath component is heated to a temperature higher than a melting point of the binder resin. Functional powders are supplied onto the melted fibers, and the fibers then cooled and cured. The fibers of the resin having a high melting point are bound to each other by the binder resin. Further, the functional powders are affixed to the fibers.

However, according to the method for affixing functional powders to the fiber surface using a binder (a binder solution, dispersion, or emulsion), the functional powders are repeatedly brought into contact with the fiber surfaces, or the binder is allowed to flow until it is cured by heat after brought into contact with the fiber surfaces. As a result, the binder is affixed to a portion other than contact points between the functional powders and the fiber surface to excessively cover the surface of the functional powders, and thus, the function of the functional powders may not be effectively exerted.

According to the method for affixing functional powders by melting a binder resin as a sheath component in a core-sheath type hot-melt fiber, the functional powders are affixed under a condition that the binder resin are melted and made fluid. As a result, many functional powders are buried in a binder resin layer to excessively cover the surface of the functional powders, and thus the function of the functional powders may not be effectively exerted.

Further, according to the method disclosed in the publication, the binder or the binder resin is made fluid and leaked from gaps between the functional powders and the binder or binder resin. Therefore, a problem occurs in that the functional powders are partially stacked by affixing other functional powders on the outside of each of the functional powders and are not uniformly carried on the fiber surface.

As a method other than that of using the binder or the core-sheath type hot-melt fiber as disclosed in the publication, a method for affixing functional powders by heating and melting a fiber not having the core-sheath structure but consisting of a single resin component may be considered. According to this method, in addition to the above problems, whole fibers are melted, and thus a problem occurs of broken threads or a shrinkage of fibers.

SUMMARY OF THE INVENTION

The object of the present invention is to remedy the above disadvantages of the prior art and provide a process for manufacturing a fiber or a fiber sheet carrying solid particles on the fiber surface or the surface of the fibers which form the fiber sheet, so that the surface properties of the solid particle are effectively maintained and the solid particles are uniformly affixed, and further, provide a manufacturing apparatus which is suitable therefor, and a novel fiber carrying solid particles and a novel fiber sheet carrying solid particles.

The object of the present invention can be attained by the process of the present invention, i.e., a process for manufacturing a fiber having at least a surface comprised mainly of a thermoplastic resin and carrying solid particles affixed to the surface, comprising the steps of:

heating the solid particles having a melting point or a decomposition point higher than a melting point of the thermoplastic resin, to a temperature higher than the melting point of the thermoplastic resin, bringing the heated solid particles into contact with the fiber while maintaining the temperature of the heated solid particles higher than the melting point of the thermoplastic resin to bond the solid particles to a fiber surface by fusing the fiber surface, and cooling the fused fiber carrying the solid particles to affix the solid particles to the fiber surface.

The present invention relates to a process for manufacturing a fiber sheet comprising fibers having at least a surface comprised mainly of a thermoplastic resin and carrying solid particles affixed to the surface, comprising the steps of:

heating the solid particles having a melting point or a decomposition point higher than a melting point of the thermoplastic resin, to a temperature higher than the melting point of the thermoplastic resin, bringing the heated solid particles into contact with the fiber sheet while maintaining the temperature of the heated solid particles higher than the melting point of the thermoplastic resin to bond the solid particles to a fiber surface by fusing the fiber surface, and cooling the fused fiber sheet carrying the solid particles to affix the solid particles to the fiber surface.

Further, the present invention relates to an apparatus for manufacturing a fiber having at least a surface comprised mainly of a thermoplastic resin and carrying solid particles affixed to the surface comprising a particle-forming means for forming an air stream containing the solid particles;

a means for spraying an air stream containing the solid particles formed by the particle-forming means;

a heating means placed in the particle-forming means and/or spraying means and capable of forming an air stream containing heated solid particles heated to a temperature higher than a melting point of the thermoplastic resin; and a means for supporting the fiber at the position where the air stream containing the solid particles sprayed from the spraying means is capable of coming into contact with the fiber surface.

Further, the present invention relates to an apparatus for manufacturing a fiber sheet comprising fibers having at least a surface comprised mainly of a thermoplastic resin and carrying solid particles affixed to the surface comprising a particle-forming means for forming an air stream containing the solid particles;

a means for spraying an air stream containing the solid particles formed by the particle-forming means;

a heating means placed in the particle-forming means and/or spraying means and capable of forming an air stream containing heated solid particles heated to a temperature higher than a melting point of the thermoplastic resin; and a means for supporting the fiber sheet at the position where the air stream containing the solid particles sprayed from the spraying means is capable of coming into contact with the surface of the fiber sheet.

Further, the present invention relates to a fiber having at least a surface comprised mainly of a thermoplastic resin and carrying solid particles affixed to the surface, wherein a melting point or a decomposition point of the solid particle is higher than a melting point of the thermoplastic resin, an average particle size of the solid particle is equal to or less than ⅓ of an average diameter of the fiber, and a percentage of an exposed surface area obtained by a BET method (Se) of the solid particles carried on the fiber surface with respect to a total surface area obtained by a BET method (Sp) of the solid particles before being carried on the fiber surface, a rate of an effective surface [(Se/Sp,)×100], is 50% or more.

Further, the present invention relates to a fiber sheet comprising the fibers carrying solid particles.

DESCRIPTION OF THE PREFERRED EMBODIMENTS

Figure 1:
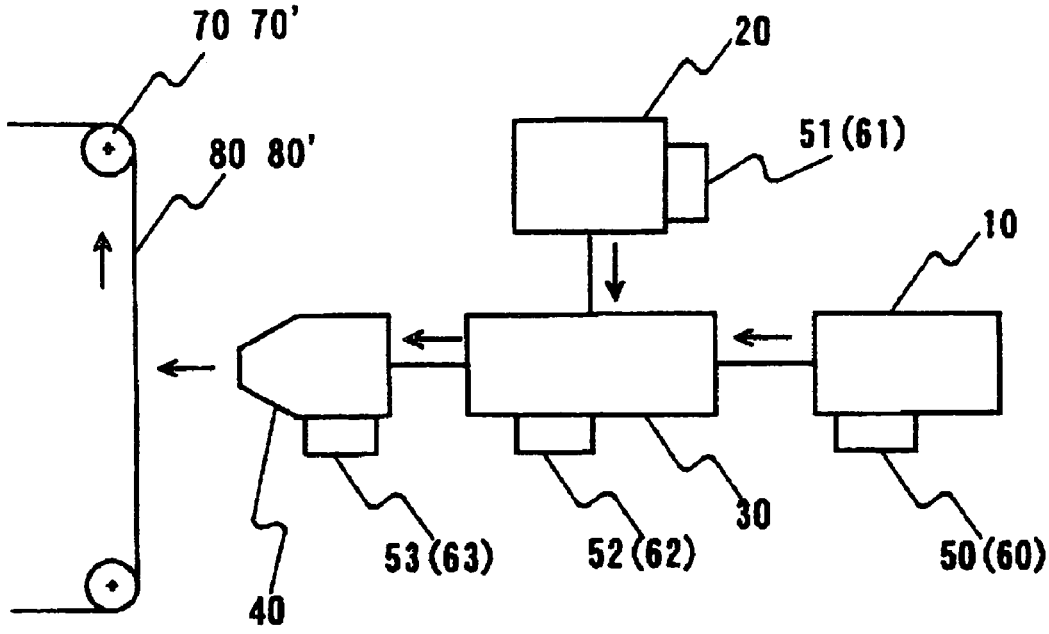
FIG. 1 schematically illustrates an embodiment of the present invention of the apparatus for manufacturing a fiber or fiber sheet carrying solid particles.

[1] Process of the Present Invention for Manufacturing a Fiber or Fiber Sheet Carrying Solid Particles According to the process of the present invention for manufacturing a fiber carrying solid particles, a fiber having at least a surface comprised mainly of a thermoplastic resin and carrying solid particles affixed to the surface thereof is obtained. In the process for manufacturing a fiber carrying solid particles of the present invention, the solid particles having a melting point or a decomposition point higher than a melting point of the thermoplastic resin are heated to a temperature higher than the melting point of the thermoplastic resin. The heated solid particles are brought into contact with the fiber while maintaining the temperature of the heated solid particles over the melting point of,the thermoplastic resin to bond the solid particles to a fiber surface by fusing the fiber surface. The fused fiber carrying the solid particles is cooled to affix the solid particles to the fiber surface.

According to the process of the present invention for manufacturing a fiber sheet carrying solid particles, a fiber sheet comprising fibers having at least a surface comprised mainly of a thermoplastic resin and carrying solid particles affixed to the surface thereof is obtained. In the process of the present invention for manufacturing a fiber sheet carrying solid particles, the solid particles having a melting point or a decomposition point higher than a melting point of the thermoplastic resin are heated to a temperature higher than the melting point of the thermoplastic resin. The heated solid particles are brought into contact with the fiber sheet while maintaining the temperature of the heated solid particles higher than the melting point of the thermoplastic resin to bond the solid particles to a fiber surface by fusing the fiber surface. The fused fiber sheet carrying the solid particles is cooled to affix the solid particles to the fiber surface.

The fiber used in the process of the present invention for manufacturing a fiber carrying solid particles, or the fiber contained in the fiber sheet used in the process of the present invention for manufacturing a fiber sheet carrying solid particles is not particularly limited, so long as it is a fiber having at least a surface comprised mainly of a thermoplastic resin and which surface may be melted by heating (for example, heating at 50° C. or more, particularly 80° C. or more). As the fiber, there may be mentioned, for example, a synthetic fiber obtained by a melt spinning as a conventional method for manufacturing a fiber, a fiber obtained by a spun-bonding method, a melt-blown method, or a flush-spinning method as a conventional method for manufacturing a nonwoven fabric, or a fiber having a core component of a natural fiber or an inorganic fiber.

As the synthetic fiber or the fiber obtained by a method of a nonwoven fabric, there may be mentioned, for example, a synthetic fiber consisting of one or more thermoplastic resins. The synthetic fiber may be a synthetic fiber consisting of a thermoplastic resin, or a composite fiber consisting of two or more different resins. As the composite fiber, there may be mentioned, for example, a composite fiber consisting of two or more resins different from each other with respect to a melting point thereof. As a combination of resins in the composite fiber, there may be mentioned, for example, polyester/copolymerized polyester, polypropylene/copolymerized polypropylene, polypropylene/polyamide, polyethylene/polypropylene, polypropylene/polyester, or polyethylene/polyester. As the composite fiber, a core-sheath type composite fiber consisting of a core polymer with a high melting point and a sheath polymer with a low melting point is preferable, because the solid particles are affixed to the fiber surface, and thus broken threads or a shrinkage of fibers rarely occurs.

Further, as the fiber used in the present invention, a fiber wherein a thermoplastic resin as a sheath component is coated, for example, by a coating process, on the surface of a fiber not having a melting point but having a decomposition point (such as a rayon fiber, acetate fiber, wool fiber, or carbon fiber) as a core component may be used. Furthermore, a fiber wherein a thermoplastic resin as a sheath component is coated, for example, by a coating process, on the surface of an inorganic fiber with a high melting point (such as a glass fiber, ceramic fiber, or metal fiber) as a core component may be used.

The fiber having at least a surface comprised mainly of a thermoplastic resin may be, for example, a fiber having a surface consisting of one or more thermoplastic resins, a fiber having a surface consisting essentially of one or more thermoplastic resins, or a fiber having a surface comprised mainly of one or more thermoplastic resins. The fiber having a surface consisting of one or more thermoplastic resins, or the fiber having a surface consisting essentially of one or more thermoplastic resins is preferable. The expression "mainly comprised of" as used herein means that the subject thermoplastic resins account for more than 50 mass %, preferably 60 mass % or more, more preferably 70 mass % or more, most preferably 90 mass % or more, with respect to constituent resins of the fiber surface. The cross-sectional shape or surface shape of the fiber is not particularly limited, but may be, for example, a fiber whose cross-sectional shape is chrysanthemum-like shape obtained by splitting a composite fiber consisting of thermoplastic resins by a mechanical stress such as a water jet, or a fibrillated fiber.

The average diameter or length of the fiber is not particularly limited, but may be appropriately selected from that of, for example, a synthetic fiber obtained by a melt spinning as a conventional method for manufacturing a fiber, a fiber obtained by a spun-bonding method, a melt-blown method, or a flush-spinning method as a conventional method for manufacturing a nonwoven fabric; or a fiber having a core component of a natural fiber or an inorganic fiber. For example, the average diameter of the fiber may be selected from a wide range such as 0.1 μm to 3 mm, preferably 0.1 μm to 500 μm, more preferably 0.1 μm to 100 μm.

The term "average diameter of the fiber" as used herein means a number average fiber diameter determined by a random sampling of 500 or more points of the fiber. When a cross-sectional shape of the fiber is not circular, the "diameter" means a diameter of a circle having an area the same as a cross-sectional area of the fiber.

Further, when it is difficult to measure the cross-sectional area of the fiber, the fiber diameter may be determined from, for example, a scanning electron micrograph of a side of the fiber. As the average diameter of the fiber, a number average fiber diameter determined by a random sampling of 500 or more points in the micrograph may be used.

Furthermore, when the fiber is commercially available, a number average fiber diameter shown in a catalogue or specification may be used as the average diameter of the fiber. When a unit of the fiber diameter shown in a catalogue or specification is denier or dtex, a value converted therefrom may be used as the average diameter of the fiber.

The fiber sheet used in the process of the present invention for manufacturing a fiber sheet carrying solid particles is not particularly limited, so long as it is a fiber sheet comprising the above-mentioned fibers, i.e., fibers having at least a surface comprised mainly of a thermoplastic resin. The fiber sheet may consist essentially of the fibers, or comprise fibers other than the fiber. The fiber other than the fiber having at least a surface comprised mainly of a thermoplastic resin is not particularly limited, but may be, for example, an inorganic fiber, or a fiber not having a melting point but having a decomposition point.

As a structure of the fiber sheet, there may be mentioned, for example, a woven fabric, a knitted fabric, a nonwoven fabric, or a composite fabric thereof. The woven fabric or knitted fabric may be obtained by processing the fibers using a loom or a knitting machine. The nonwoven fabric may be obtained by, for example, a dry-laid method, a spun-bonding method, a melt-blown method, a flush-spinning method, or a wet-laid method as a conventional method for manufacturing a nonwoven fabric. Further, a fiber sheet wherein fibers are bonded to each other may be obtained by mixing the fiber web formed by these methods with, for example, an adhesive fiber and/or a composite fiber consisting of two or more resins different from each other with respect to a melting point thereof, and heating the mixture. Furthermore, a fiber sheet wherein fibers are entangled may be obtained by an action for mechanically entangling (such as hydroentanglement or needle punching) the fiber webs to each other. A fiber sheet wherein fibers are partially bonded may be obtained by passing the fiber web between a heated embossing roll and a heated smoothing roll. An integrated fiber sheet may be obtained by laminating the different fiber sheets.

A shape of the fiber sheet is not particularly limited, but includes, for example, a continuous sheet such as a sheet wound on a roll, or a discontinuous sheet (i.e., a sheet obtainable by cutting the continuous sheet) such as a leaf or a squared sheet.

The solid particle used in the process of the present invention for manufacturing a fiber or fiber sheet carrying solid particles is not particularly limited, so long as it is a solid particle having a melting point or a decomposition point higher than a melting point of the thermoplastic resin which forms the surface of the fiber used for affixing the solid particles. As the solid particle, one or more particles may be appropriately selected from inorganic solid particles or organic solid particles. When the solid particle is a solid particle having a function, such as deodorization, gas removal, catalyst (for example, photocatalyst), water absorption, ion exchange, electromagnetic wave radiation, ion generation, antimicrobe, flame retardance, electromagnetic wave shielding, noise reduction, or water repellency or oil repellency, the function may be effectively exerted on the fiber surface. As a material of such a solid particle, there may be mentioned, for example, activated carbon, zeolite, titanium oxide, water absorption resin, ion exchange resin, metal particle, tourmaline, calcium carbonate, or water repellent resin.

The melting point or decomposition point of the solid particle must be higher than a melting point of a thermoplastic resin having the lowest melting point among thermoplastic resins forming the fiber surface. If the melting point or decomposition point of the solid particle is lower than that of the resin, the fiber surface will not be melted by heated solid particles, and thus the structure wherein solid particles are carried on the fiber surface is not obtained. That is, the solid particles are not carried on the fiber surface, or if the solid particles are carried on the fiber surface, the solid particles melt before the fiber surface to become aggregates or fuse to the fiber surface with a wide area. As a result, an effective surface of the carried solid particles is decreased.

The average particle size of the solid particle is preferably equal to or less than the fiber diameter. When the average particle size of the solid particle is larger than the fiber diameter, the solid particles are liable to drop from the fiber surface, and thus it is sometimes difficult to maintain the state wherein the solid particles are affixed to the fiber surface. Further, it is sometimes difficult to affix the solid particles to the fiber surface when manufacturing the fiber carrying such solid particles. The average particle size of the solid particles is preferably 0.01 μm or more, more preferably 0.05 μm or more.

The term "average particle size of the solid particle" as used herein means a number average particle size of the solid particle. A number average particle size may be calculated by randomly measuring particle sizes of 500 or more particles in, for example, a scanning electron micrograph, and dividing the sum thereof by a number of the measured particles. When the particles are not spherical, the "particle size" means a diameter of a circumcircle of the particle displayed in the micrograph.

Further, when the particles are commercially available and a number average particle size is shown in a catalog or specification, the value may be used as the average particle size of the solid particle.

In the process of the present invention for manufacturing a fiber or a fiber sheet carrying solid particles, the solid particles heated to a predetermined temperature are brought into contact with the fiber or the fiber sheet while maintaining the predetermined temperature. A method for bringing the heated solid particles into contact with the fiber or the fiber sheet is not particularly limited, so long as, by,the contact, the solid particles are bonded to a fiber surface by fusing the fiber surface and affixed to the fiber surface by cooling the fused fiber carrying the solid particles. As the method, there may be mentioned, for example, (1) a method for spraying an air stream containing the heated solid particles onto the surface of the fiber or the fiber sheet;
(2) a method for dropping the heated solid particles onto the fiber or the fiber sheet;
(3) a method for shaking a heat-resistant container containing the heated solid particles and the fiber or the fiber sheet;
(4) a method for immersing the fiber or the fiber sheet in the heated solid particles; or
(5) a method for exposing the fiber or the fiber sheet in a fluidized bed of the heated solid particles.

When the contacting method (1) i.e., the method for spraying an air stream containing the heated solid particles onto the surface of the fiber or those of the fibers contained in the fiber sheet, is used as the method for bringing the heated solid particles into contact with the fiber or the fiber sheet, as the air stream containing the heated solid particles, a mixed air stream containing solid particles heated to a temperature equal to or higher than a melting point of a thermoplastic resin having the lowest melting point among thermoplastic resins forming the fiber surface, and an air stream, is used.

As a method for preparing such a mixed air stream, there may be mentioned, for example, (a) a method for supplying the solid particles heated to a temperature equal to or higher than a melting point of the thermoplastic resin into an air stream;
(b) a method for supplying the solid particles into an air stream heated to a temperature equal to or higher than a melting point of the thermoplastic resin; or
(c) a method for heating a mixing air stream obtained by supplying solid particles into an air stream, to a temperature equal to or higher than a melting point of the thermoplastic resin. In the method (b) or (c) for preparing a mixed air stream, the solid particles are heated to a temperature equal to or higher than a melting point of the thermoplastic resin, through the air stream heated to a temperature equal to or higher than a melting point of the thermoplastic resin.

In the manufacturing process of the present invention, it is necessary to heat solid particles to a temperature equal to or higher than a melting point of the thermoplastic resin. However, if solid particles heated to an excessively high temperature are affixed to the fiber, broken threads or a shrinkage of fibers sometimes occurs. To avoid such a problem, it is preferable to heat the solid particles to a temperature not more than a temperature 100° C. (more preferably 50° C.) higher than a melting point of the thermoplastic resin.

In the method (a) for preparing a mixed air stream, it is preferable to supply the solid particles heated to a temperature equal to or higher than a melting point of the thermoplastic resin, into an air stream heated to a temperature equal to or higher than a temperature 50° C. lower than a melting point of the thermoplastic resin. In this case, when the air stream is mixed with the solid particles, a preheating effect is obtained, so that the temperature of the solid particles does not become lower than a melting point of the thermoplastic resin. Further, an effect of warmth retaining is obtained, so that the temperature of the solid particles does not become lower than a melting point of the thermoplastic resin until the heated solid particles are brought into contact with a fiber. If a mixed air stream containing an air stream and the solid particles is sprayed onto the fiber and the air stream at an excessively high temperature is brought into contact with the fiber, broken threads or a shrinkage of fibers sometimes occurs. To avoid such a problem, it is preferable to heat the air stream to a temperature which is equal to or higher than a temperature 50° C. lower than a melting point of the thermoplastic resin and which is lower than that of the heated solid particles In the method (b) for preparing a mixed air stream, it is preferable to supply the solid particles heated to a temperature equal to or higher than a temperature 50° C. lower than a melting point of the thermoplastic resin, into an air stream heated to a temperature equal to or higher than a melting point of the thermoplastic resin. In this case, when the air stream is mixed with the solid particles, a preheating effect is obtained, so that the temperature of the solid particles does not become lower than a melting point of the thermoplastic resin.

Further, in the method (a), (b), or (c) for preparing a mixed air stream, it is preferable to optionally heat a mixed air stream obtained by mixing an air stream and the solid particles to a temperature equal to or higher than a melting point of the thermoplastic resin. In this case, an effect of warmth retaining is obtained, so that the temperature of the solid particles does not become lower than a melting point of the thermoplastic resin until the solid particles are brought into contact with a fiber.

To prepare the heated air stream, for example, a method for generating an air stream by a means for generating an air stream (such as a blower or compressor) and heating the air stream to a predetermined temperature (for example, a temperature equal to or higher than a temperature 50° C. lower than a melting point of the thermoplastic resin, or a temperature equal to or higher than a melting point of the thermoplastic resin) by a known heating means may be used.

Further, to prepare the heated solid particles, for example, a method for placing a heater on the inside and/or outside of a means for providing solid particles (such as a hopper or a supply container) and heating the solid particles in the means for providing solid particles to a predetermined temperature (for example, a temperature equal to or higher than a temperature 50° C. lower than a melting point of the thermoplastic resin, or a temperature equal to or higher than a melting point of the thermoplastic resin), or a method for heating the solid particles to a predetermined temperature (for example, a temperature equal to or higher than a temperature 50° C. lower than a melting point of the thermoplastic resin, or a temperature equal to or higher than a melting point of the thermoplastic resin) using an apparatus generally used as a dryer for powder, for example, a fluidized bed-type dryer may be used.

As a method for preparing the mixed air stream by supplying the solid particles into an air stream, there may be mentioned, for example, a method for supplying the solid particles from a means for providing solid particles (such as a hopper or a supply container) into an air stream by degrees, or a method for heating the solid particles to a temperature equal to or higher than a melting point of the thermoplastic resin using an apparatus such as a fluidized bed-type dryer and supplying a mixed air stream in which the heated solid particles are dispersed from the apparatus into an air stream.

Figure 2:
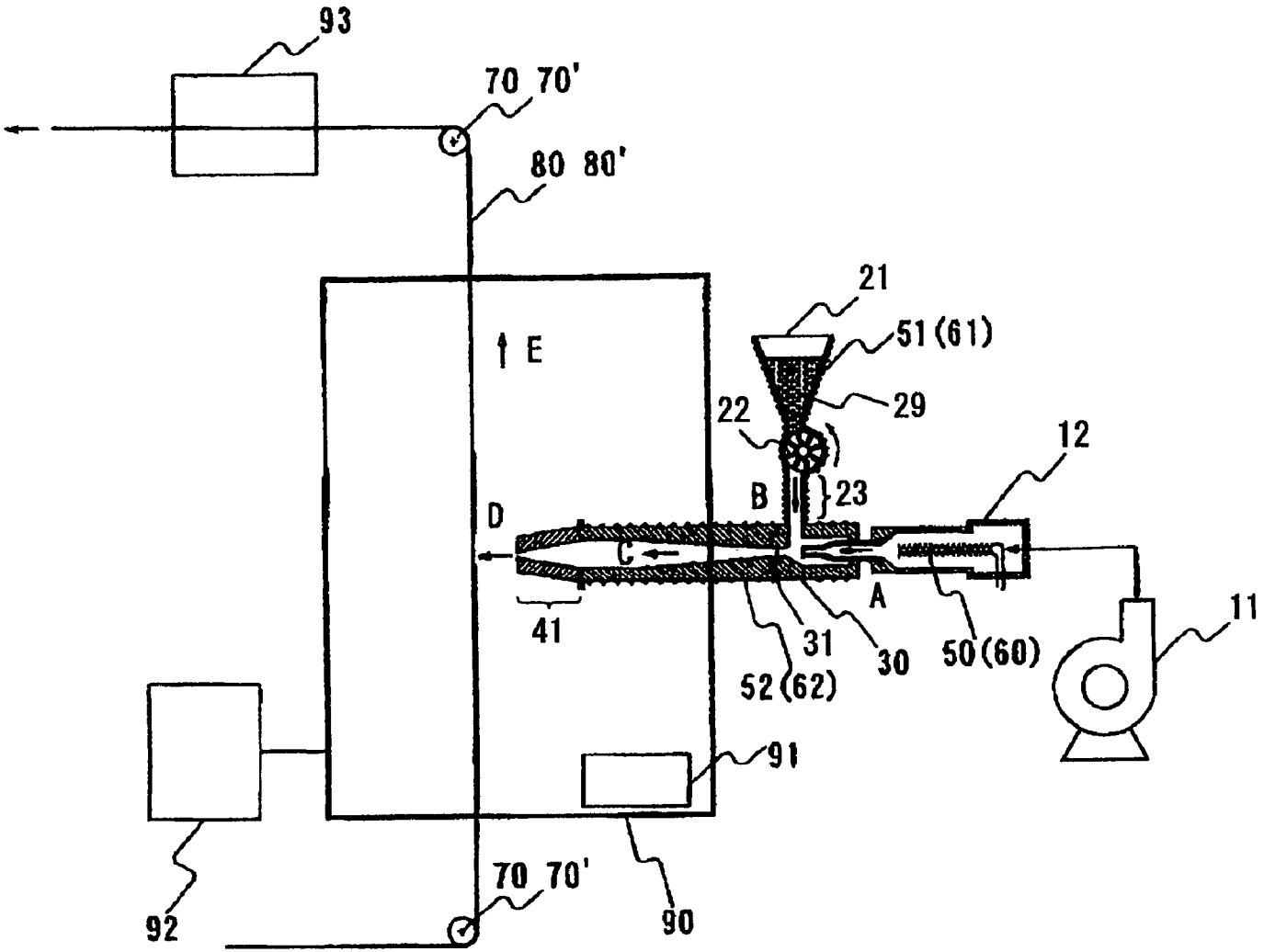
FIG. 2 schematically illustrates another embodiment of the present invention of the apparatus for manufacturing a fiber or fiber sheet carrying solid particles.

Further, a method as shown, for example, in FIG. 2, may be used. In FIG. 2, a particle-mixing means 30 is an ejector. An air stream A generated in a blower 11 and a heating pipe 12 as an air stream-generating means is passed to the particle-mixing means 30 connected to a particle-providing means (i.e., a funnelform supply container 21, a rotary supply control rotor 22, and a feed pipe 23). By a suction generated by the air stream A, the solid particles supplied from the particle-providing means are aspirated and provided into the air stream. In this case, when a cross-sectional area of an air stream C of a portion 31 where the particles are supplied in the particle-mixing means 30 is decreased in comparison with that before and after the portion 31, the speed of the air stream and the suction are increased, and thus, the effect for dispersing and mixing the solid particles may be increased.

Figure 3:
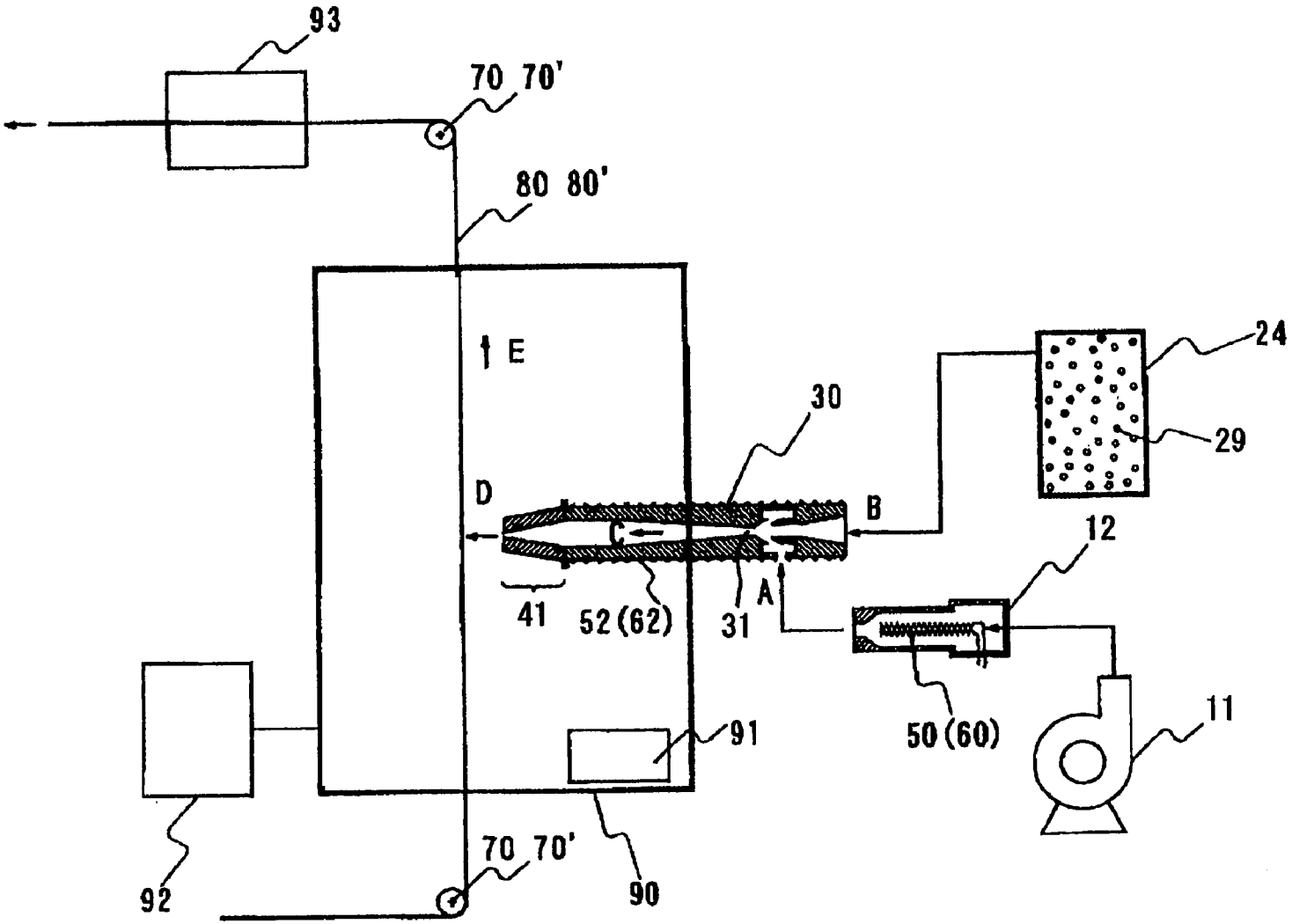
FIG. 3 schematically illustrates still another embodiment of the present invention of the apparatus for manufacturing a fiber or fiber sheet carrying solid particles.

Furthermore, a method as shown in, for example, FIG. 3, may be used. In FIG. 3, a particle-mixing means 30 is an ejector. An air stream A generated in a blower 11 and a heating pipe 12 as an air stream-generating means is passed to the particle-mixing means 30. A heated mixed air stream in which the solid particles are dispersed is passed from a fluidized bed-type dryer 24 as a particle-providing means into the particle-mixing means 30. By a suction generated by the air stream A, the mixed air stream supplied from the particle-providing means 24 is aspirated and the solid particles are provided into the air stream.

When the contacting method (1), i.e., the method for spraying an air stream containing the heated solid particles onto the surface of the fiber or those of the fibers contained in the fiber sheet, is used as the method for bringing the heated solid particles into contact with the fiber or the fiber sheet, the mixed air stream obtained as described above (i.e., mixed air stream containing the solid particles heated to a temperature equal to or higher than a melting point of a thermoplastic resin having the lowest melting point among thermoplastic resins forming the fiber surface) is sprayed onto the surface of the fiber or fiber sheet. It is preferable to maintain the temperature of the surface of the fiber or fiber sheet below a melting point of the thermoplastic resin before spraying, As a method for spraying particles onto the fiber or fiber sheet, for example, as shown in FIG. 2 or 3, the mixed air stream containing the solid particles is jetted from a nozzle 41 as a spraying means. The solid particles are brought into contact with the fiber surface by an inertial force derived from a kinetic energy produced when spraying from the nozzle 41. The spraying means may be connected to, for example, the particle-mixing means 30 directly or via a connecting pipe. The shape of the nozzle may be a shape appropriate to spraying a fluid. For example, the passage of the nozzle may be narrowed to increase an inertial force of the solid particles, or a tip of the nozzle may be expanded to increase a spraying angle of the solid particles. Further, it is preferable to use a nozzle material having an abrasion resistance in accordance with the solid particles sprayed from the nozzle.

When the method for spraying an air stream containing the heated solid particles onto the surface of the fiber or those of the fibers contained in the fiber sheet is used as the method for bringing the heated solid particles into contact with the fiber or the fiber sheet, it is preferable to spray the air stream containing the heated solid particles onto the fiber or fiber sheet supported by a movable means for supporting the fiber or fiber sheet. The supporting means is not particularly limited, so long as the spraying with the air stream containing the heated solid particles may be carried out. As a preferable means, there may be mentioned, for example, a rotary roller placed before and after the area where the treatment by spraying with the air stream containing the heated solid particles is carried out and capable of moving the fiber or fiber sheet, a tenter apparatus capable of supporting and moving the fiber or fiber sheet by clipping both sides thereof with pins or clips, a pair of rollers capable of sandwiching and supporting the fiber or fiber sheet, or a supporting net (such as a conveyer net) capable of spraying the fiber or fiber sheet placed thereon. Plural fibers may be supported by the conveyer net or the like at the same time.

When spraying the air stream containing the heated solid particles onto the fiber or fiber sheet supported by the supporting means, plural means for spraying an air stream containing the heated solid particles may be placed or plural nozzles may be placed in the spraying means. In this case, spraying may be uniformly carried out with respect to the width direction. Further, the ejecting opening of the nozzle may be a slit and the tip of the nozzle may be expanded to the width of the fiber sheet. Furthermore, the spraying means may be reciprocated in parallel with the width direction of the fiber sheet and in a direction crossing at a right angle or an appropriate angle to the direction of movement of the fiber sheet. In this case, the whole of the fiber sheet may be treated by a minimum of spraying means.

Further, it is preferable to collect and recycle excessive solid particles not affixed to the fiber or fiber sheet after spraying the air stream containing the heated solid particles thereon. Such a collection method is exemplified in FIGS. 2 and 3. As shown in FIGS. 2 and 3, an atmosphere where the air stream containing the heated solid particles is sprayed onto the fiber 80 or fiber sheet 80' is surrounded with a processing room for affixation 90, so that excessive solid particles can not scatter outside of the processing room for affixation 90. A particle-collection box 92 as a means for collecting particles is connected to the processing room for affixation 90, and excess solid particles are collected by the particle-collection box 92. Further, to remove the excess solid particles not affixed to the fiber or fiber sheet, a method for dropping the excess solid particles by inclining and vibrating a conveyer net, or a particle-collection means 93 which can blow the particles away by an air stream may be used.

A method for cooling the fused fiber carrying the solid particles obtained by bringing the solid particles into contact with the fiber surface is not particularly limited, so long as the solid particles may be cooled to a temperature capable of affixing to the fiber surface. For example, the fused fiber carrying the solid particles may be allowed to stand at room temperature, or an appropriate cooling means may be optionally used.

When one of the contacting methods (2) to (5) is used as the method for bringing the heated solid particles into contact with the fiber or the fibers contained in the fiber sheet, the solid particles are preheated and then brought into contact with the fiber or the fibers contained in fiber sheet by various contacting methods.

As a method for heating the solid particles, there may be mentioned, for example, a method for placing the solid particles into a heat-resistant container and heating in an oven, or a method for placing the solid particles on a heat-resistant conveyer and successively heating the particles by a heater placed over the conveyer, while moving the conveyer. A method for heating the solid particles is not particularly limited, so long as the whole of the solid particles are heated. It is necessary to heat the particles to a temperature higher than a melting point of a thermoplastic resin having the lowest melting point among thermoplastic resins forming the fiber surface.

A method for bringing the heated solid particles into contact with the fiber or the fibers contained in the fiber sheet is not particularly limited, so long as a fiber having at least a surface comprised mainly of a thermoplastic resin or a fiber sheet containing fibers having at least a surface comprised mainly of a thermoplastic resin may be brought into contact with the heated solid particles while maintaining the temperature of the fiber or fiber sheet at room temperature or a temperature lower than a melting point of the fiber surface. As the method, there may be mentioned, for example, a method for placing the fiber or fiber sheet on a conveyer and dropping (for example, sprinkling) the solid particles from a point above the conveyer [i.e., the above contacting method (2)], a method for placing the fiber or fiber sheet and the solid particles together into a container and shaking the container [i.e., the above contacting method (3)], a method for immersing the fiber or the fiber sheet in a layer of the solid particles [i.e., the above contacting method (4)], or a method for exposing the fiber or the fiber sheet in a fluidized bed of the solid particles [i.e., the above contacting method (5)].

For example, in the above contacting method (2), i.e., a method for dropping the heated solid particles onto the fiber or the fiber sheet, for example, the fiber or fiber sheet is placed on a moving heat-resistant conveyer, and then the heated solid particles are, for example, sprinkled from a point above the conveyer. As soon as the heated solid particles are brought into contact with the fiber surface, the heated solid particles are carried on the fiber surface under a condition that only contact points between a thermoplastic resin on the fiber surface and the solid particles are melted. The solid particles are affixed to the fiber surface by cooling the fiber or fiber sheet and the solid particles by being allowed to stand at room temperature, or optionally using an appropriate cooling means, for example, by spraying a cool air from a point above the conveyer. The solid particles not affixed to the fiber carrying solid particles or the fiber sheet carrying solid particles are removed by an appropriate means for removing solid particles, for example, by inclining and vibrating a conveyer or blowing the particles away by an air stream.

In the above contacting method (3), i.e., a method for shaking a heat-resistant container containing the heated solid particles and the fiber or the fiber sheet, for example, the fiber or fiber sheet is placed into a heat-resistant container, and the heated solid particles are further placed therein. The container is then shut and shaken. As soon as the heated solid,particles are brought into contact with the fiber surface, the heated solid particles are carried on the fiber surface under a condition that only contact points between a thermoplastic resin on the fiber surface and the solid particles are melted. The fiber or fiber sheet is quickly taken from the container and cooled to affix the solid particles to the fiber surface. The solid particles not affixed to the fiber carrying solid particles or the fiber sheet carrying solid particles are removed by an appropriate removing means, for example, by washing.

According to the manufacturing process of the present invention (the process of the present invention for manufacturing a fiber carrying solid particles and the process of the present invention for manufacturing a fiber sheet carrying solid particles are included), the heated solid particles are brought into contact with the fiber surface, and thus the solid particles are carried on the fiber surface by melting only contact portions between the solid particles and the fiber surface. As a result, a surface portion other than the contact portions or affixed portions in the surface of the solid particles is rarely covered with a molten resin. Further, the whole resin on the fiber surface is rarely melted and made fluid, and thus the solid particles are rarely buried.

A molten resin is rarely leaked from gaps between the solid particles and the fiber surface. Therefore, a problem that the solid particles are partially stacked by affixing other solid particles on the outside of each of the solid particles and not uniformly carried on the fiber surface does not occur. Further, the solid particles may be affixed or carried on the fiber surface as a uniform monolayer.

According to the manufacturing,process of the present invention, because the solid particles melt only the fiber surface, if a fiber consisting of one resin component is treated, a problem that the fiber is shrunk, melted as a whole, or broken during a treatment for contact or affixation does not occur. Further, an advantageous effect that a heat deterioration of the whole fiber or the fiber surface does not occur, or the damage thereof may be decreased if this does occur.

Further, the solid particles are strongly affixed to and carried on the fiber surface by cooling after contact, and thus the solid particles are not easily removed from the fiber surface by, for example, a washing test for retention.

In the manufacturing process of the present invention, when using the above contacting method (1) (i.e., the method for spraying an air stream containing the heated solid particles onto the surface of the fiber or those of the fibers contained in the fiber sheet) as a method for bringing the heated solid particles into contact with the fiber or the fiber sheet, the air stream containing the heated solid particles is sprayed onto the fiber surface. As a result, the solid particles are brought into contact with the fiber surface by an inertial force of the solid particles, and thus the solid particles may be strongly affixed to the fiber surface.

On the contrary, according to the conventional process, i.e., a process by heating not the solid particles but the fiber and bringing the solid particles into contact with the fiber, a binder or the heated molten fibers are brought into contact with the solid particles, and thus a surface portion other than the contact portions or affixed portions of the surface of the solid particles is covered with the binder or the molten resin. Further, the binder or the molten resin on the fiber surface is made fluid, and thus the solid particles are buried. Furthermore, the binder or the molten resin is leaked from gaps between the solid particles and the fiber surface. Therefore, a problem that the solid particles are partially stacked by affixing other solid particles on the outside of each of the solid particles, and are not uniformly carried on the fiber surface, occurs. As a result, in the conventional process, the surface function of the solid particle may not be effectively exerted, after the solid particles are affixed to or carried on the fiber surface. Further, because the whole fiber is heated to melt the fiber surface in the conventional process, if a fiber consisting of one resin component is treated, a problem that the fiber is shrunk, melted as a whole, or broken during a treatment for contact or affixation occurs.

[2] Apparatus of the Present Invention for Manufacturing a Fiber or Fiber Sheet Carrying Solid Particles The apparatus for manufacturing a fiber carrying solid particles of the present invention comprises at least a particle-forming means, a spraying means, a heating means, and a fiber-supporting means. The particle-forming means comprises, for example, an air stream-generating means, a particle-providing means, and a particle-mixing means.

The apparatus for manufacturing a fiber sheet carrying solid particles of the present invention comprises at least a particle-forming means, a spraying means, a heating means, and a fiber sheet-supporting means. The particle-forming means comprises, for example, an air stream-generating means, a particle-providing means, and a particle-mixing means.

The basic structure of the apparatus of the present invention for manufacturing a fiber or fiber sheet carrying solid particles is shown in FIG. 1.

The apparatus as shown in FIG. 1 may be used as the apparatus for manufacturing a fiber carrying solid particles of the present invention, by using a fiber 80 as an article to be treated and a fiber-supporting means 70 capable of supporting the fiber 80 as a means for supporting an article to be treated. Further, the apparatus as shown in FIG. 1 may be used as the apparatus of the present invention for manufacturing a fiber sheet carrying solid particles, by using a fiber sheet 80' as an article to be treated and a fiber sheet-supporting means 70' capable of supporting the fiber sheet 80' as a means for supporting an article to be treated. Hereinafter, the apparatus of the present invention will be explained, mainly in accordance with the case wherein the apparatus of the present invention is used for manufacturing a fiber carrying solid particles.

The apparatus of the present invention for manufacturing a fiber carrying solid particles as shown in FIG. 1, comprises an air stream-generating means 10 for generating an air stream;

a particle-providing means 20 for providing the solid particles;

a particle-mixing means 30 respectively connected to the air stream-generating means 10 and the particle-providing means 20, and capable of forming the air stream containing the solid particles by mixing the air stream generated by and supplied from the air stream-generating means 10, with the solid particles provided by the particle-providing means 20;

a spraying means 40 connected to the particle-mixing means 30, and capable of spraying an air stream containing the solid particles formed by the particle-forming means 30;

heating means 50, 51, 52, 53 respectively placed in the air stream-generating means 10, the particle-providing means 20, the particle-mixing means 30, and the spraying means 40; and a fiber-supporting means 70 for supporting the fiber 80 at the position where the air stream containing the solid particles sprayed from the spraying means 40 is capable of coming into contact with the fiber surface.

In the embodiment shown in FIG. 1, the heating means 50, 51, 52, 53 are respectively placed in all of the air stream-generating means 10, the particle-providing means 20, the particle-mixing means 30, and the spraying means 40. However, in the apparatus of the present invention, the heating means may be placed in at least one of the air stream-generating means 10, the particle-providing means 20, the particle-mixing means 30, and the spraying means 40, so long as an air stream containing heated solid particles heated to a temperature higher than a melting point of the thermoplastic resin in the fiber surface may be formed.

Further, by placing, instead of the fiber-supporting means 70, a fiber sheet-supporting means 70' capable of supporting the fiber sheet 80' at the position where the air stream containing the solid particles sprayed from the spraying means 40 is capable of coming into contact with the surface of the fiber sheet, the apparatus as shown in FIG. 1 may be used as the apparatus of the present invention for manufacturing a fiber sheet carrying solid particles.

The heating means 50, 51, 52, 53 are a heating means capable of heating to and controlling a temperature equal to or higher than a melting point of the thermoplastic resin.

If broken threads or a shrinkage of fibers occurs due to affixing the solid particles heated to an excessively high temperature to the fiber, a heating means capable of controlling a temperature in the range of a temperature of not more than a temperature 100° C. (more preferably 50° C.) higher than a melting point of the thermoplastic resin is preferable. By these heating means 50, 51, 52, 53, a mixed air stream containing an air stream and solid particles heated to a temperature equal to or higher than a melting point of a thermoplastic resin having the lowest melting point among thermoplastic resins forming the fiber surface may be obtained.

For example, by placing the heating means 51 in the particle-providing means 20, the solid particles heated to a temperature equal to or higher than a melting point of the thermoplastic resin may be supplied into an air stream. Further, by placing the heating means 50 in the air stream-generating means 10, the solid particles may be supplied into an air stream heated to a temperature equal to or higher than a melting point of the thermoplastic resin, and thus, may be heated to a temperature equal to or higher than a melting point of the thermoplastic resin, via the air stream. Furthermore, by placing the heating means 52 in the particle-mixing means 30 or placing the heating means 53 in the spraying means 40, the mixed air stream obtained by providing the solid particles into an air stream may be heated to a temperature equal to or higher than a melting point of the thermoplastic resin, and thus, the solid particles may be heated to a temperature equal to or higher than a melting point of the thermoplastic resin, via the heated air stream.

It is necessary to place the heating means 50, 51, 52, 53 in at least one of the air stream-generating means 10, the particle-providing means 20, the,particle-mixing means 30, and the spraying means 40. However, it is preferable to place the heating means in two or more of those means. In this case, a preheating effect or a warmth retaining effect may be obtained. For example, by placing the heat means 51, 50 in the particle-providing means 20 and the air stream-generating means 10, respectively, a preheating effect is obtained, so that the temperature of the solid particles does not become lower than a melting point of the thermoplastic resin, when the air stream is mixed with the solid particles. Further, an effect of warmth retaining is obtained, so that the temperature of the solid particles does not become lower than a melting point of the thermoplastic resin until the heated solid particles are brought into contact with a fiber. For example, by the heating means 51, 52 in the particle-providing means 20 and the particle-mixing means 30, respectively, an effect of warmth retaining is obtained, so that the temperature of the solid particles does not become lower than a melting point of the thermoplastic resin until the heated solid particles are brought into contact with a fiber.

When placing the heating means 50, 51, 52, 53 in two or more means, it is sometimes preferable to independently control the heating means in the range of a temperature equal to or higher than a melting point of the thermoplastic resin. For example, in the case of placing the heating means 51 in the particle-providing means 20, broken threads or a shrinkage of fibers may occur due to bringing the air stream heated to an excessively high temperature into contact with the fiber, when spraying a mixed air stream containing an air stream and solid particles onto the fiber. If such a problem occurs, the problem may be solved by placing the heating means 51, 50 in the particle-providing means 20 and the air stream-generating means 10, respectively, and keeping a temperature of the heating means 50 below a temperature of the heating means 51.

In the apparatus of the present invention, in at least one of the air stream-generating means 10, the particle-providing means 20, the particle-mixing means 30, and the spraying means 40, additional heating means 60, 61, 62, 63 capable of controlling temperatures of the solid particles and/or the air stream to a temperature equal to or higher than a temperature 50° C. lower than a melting point of the thermoplastic resin and a temperature lower than a melting point of the thermoplastic resin may be placed. By placing such an additional heating means 60, 61, 62, 63 in addition to the heating means 50, 51, 52, 53, the above preheating effect may be obtained. For example, in the case of placing the heating means 51 in the particle-providing means 20, broken threads or a shrinkage of fibers may occur due to bringing the air stream heated to an excessively high temperature into contact with the fiber, when spraying a mixed air stream containing an air stream and solid particles onto the fiber. If such a problem occurs, the problem may be solved by placing the heating means 51 in the particle-providing means 20 and further placing the additional heating means 60 in the air stream-generating means 10.

Still other embodiments of the present invention are shown in FIGS. 2 and 3, respectively. As for the embodiment shown in FIG. 1, the embodiments shown in FIGS. 2 and 3 may be used as the apparatus of the present invention for manufacturing a fiber carrying solid particles, by using a fiber 80 as an article to be treated and a fiber-supporting means 70 capable of supporting the fiber 80 as a means for supporting an article to be treated. Further, the embodiments shown in FIGS. 2 and 3 may be used as the apparatus of the present invention for manufacturing a fiber sheet carrying solid particles, by using a fiber sheet 80' as an article to be treated and a fiber sheet-supporting means 70' capable of supporting the fiber sheet 80' as a means for supporting an article to be treated.

In the embodiment shown in FIG. 2, an air stream generated in a blower 11 as an air stream-generating means is passed to a heating pipe 12 as an air stream-generating means. The air stream is heated, by a heating means 50 placed in the heating pipe 12, to a temperature a ° C. equal to or higher than a melting point of a thermoplastic resin having the lowest melting point among thermoplastic resins forming the fiber surface. The heated air stream A is supplied into a particle-mixing means 30. The particle-mixing means 30 is connected to a particle-providing means consisting of a funnelform supply container 21, a rotary supply control rotor 22, and a feed pipe 23. A heating means 51 capable of heating solid particles 29 to a temperature equal to or higher than a melting point of the thermoplastic resin is placed on the outside of the particle-providing means. The solid particles 29 heated to a temperature b ° C. (b ° C.≧a ° C.) equal to or higher than a melting point of the thermoplastic resin are supplied into the heated air stream passing in the particle-mixing means 30 from the feed pipe 23 to form a mixed air stream containing the solid particles 29 heated to a temperature equal to or higher than a melting point of the thermoplastic resin and the air stream in the particle-mixing means 30.

In the embodiment shown in FIG. 2, the particle-mixing means 30 has a structure wherein the solid particles 29 supplied from the feed pipe 23 are aspirated into an air stream C by a suction generated by the stream A. A passage for supplying the solid particles 29 is formed in a direction crossing at a right angle or an appropriate angle to the direction of the air stream C. A cross-sectional area of the air stream C in a portion 31 crossing the supply passage is reduced in comparison with that before and after the portion 31. As a result, the speed of the air stream and the suction are increased in the portion 31, and thus the effect for dispersing and mixing the solid particles may be increased. The direction of the flow B may be the same as that of the air steam C.

In the embodiment shown in FIG. 3, an air stream A generated in a blower 11 and a heating pipe 12 as an air stream-generating means is supplied into a particle-mixing means 30. At the same time, a mixed gas in which the heated solid particles 29 are dispersed is supplied from a fluidized bed-type dryer 24 as a particle-providing means into the particle-mixing means 30. The particle-mixing means 30 has a structure wherein the mixed gas supplied from the fluidized bed-type dryer 24 is aspirated into an air stream C by a suction generated by the stream A.

In the embodiments shown in FIGS. 2 and 3, the mixed air stream is passed into a nozzle 41 as a spraying means connected to the particle-mixing means 30, and sprayed from the nozzle 41. A fiber 80 or a fiber sheet 80' movably supported by rollers 70 as a fiber-supporting means or rollers 70' as a fiber sheet-supporting means is placed in front of the nozzle 41. The solid particles 29 sprayed from the nozzle 41 as the mixed air stream is sprayed onto the fiber surface of the fiber 80 or fiber sheet 80'.

In the embodiments shown in FIGS. 2 and 3, an atmosphere where the solid particles 29 are sprayed onto the fiber 80 or fiber sheet 80' is surrounded with a processing room for affixation 90, so that excess solid particles 29 can not scatter on the outside of the processing room for affixation 90. A particle-collection box 92 as a means for collecting particles is connected to the processing room for affixation 90. The excess solid particles 29 are collected by the particle-collection box 92. Further, to remove and collect the excess solid particles 29 not affixed to the fiber or fiber sheet, a particle-collection means 93 which can blow the particles away by an air stream is utilized.

In the embodiments shown in FIGS. 2 and 3, together with these methods, for example, a method for dropping the excess solid particles 29 by inclining and vibrating a conveyer net as a fiber sheet-supporting means may be used.

In the embodiments shown in FIGS. 2 and 3, a room-heating means 91 for heating a gas in a room is placed in the processing room for affixation 90. The room-heating means 91 may heat a gas in the room to a temperature not higher than a melting point of a thermoplastic resin having the lowest melting point among thermoplastic resins forming the fiber surface of the fiber 80 or fiber sheet 80', to help an affixation of the solid particles 29 to the fiber 80 or fiber sheet 80'.

In the embodiment shown in FIG. 2, a heating means 51 capable of heating the solid particles 29 to a temperature equal to or higher than a melting point of the thermoplastic resin is placed in the funnelform supply container 21, the rotary supply control rotor 22, and the feed pipe 23 as a particle-providing means. In the embodiment shown in FIG. 3, a heating means 50 is placed in the heating pipe 12 as an air stream-generating means. The heating means may be placed in at least one of the particle-providing means, the air stream-generating means, the particle-mixing means, or the spraying means, and thus, solid particles may be heated directly or via a heating of the air stream A or air stream C to a temperature equal to or higher than a melting point of the thermoplastic resin. In the embodiment shown in FIG. 2, the supply container 21, the rotary supply control rotor 22, and the feed pipe 23 as a particle-providing means, the heating pipe 12 as an air stream-generating means, and the particle-mixing means 30 may be heated to a temperature equal to or higher than a temperature 50° C. lower than a melting point of the thermoplastic resin by placing therein additional heating means 60, 61, 62.

In the embodiment shown in FIG. 2, the particle-mixing means 30 is connected to the particle-providing means consisting of the funnelform supply container 21, the rotary supply control rotor 22, and the feed pipe 23. The particle-providing means is not particularly limited to this embodiment. For example, as shown in FIG. 3, the solid particles 29 may be provided into an air stream by heating the solid particles 29 to a temperature equal to or higher than a melting point of a thermoplastic resin having the lowest melting point among thermoplastic resins forming the fiber surface in the fluidized bed-type dryer 24, and passing a mixing gas in which the heated solid particles 29 are dispersed from the fluidized bed-type dryer 24 into the particle-mixing means 30.

In the embodiments shown in FIGS. 2 and 3, the nozzle 41 having a narrowed tip as a spraying means is directly connected to the particle-mixing means 30, but may be connected thereto via a connecting pipe. Further, the shape of the nozzle 41 may be a shape appropriate to spraying a fluid. For example, the passage of the nozzle may be narrowed to increase an inertial force of the solid particles 29, or a tip of the nozzle may be expanded to increase a spraying angle of the solid particles 29. It is preferable to use a nozzle material having an abrasion resistance in accordance with the solid particles 29 sprayed from the nozzle 41.

In the embodiments shown in FIGS. 2 and 3, when spraying the solid particles 29 onto the fiber 80 or fiber sheet 80' supported by rollers 70 as a fiber-supporting means or rollers 70' as a fiber sheet-supporting means, plural nozzles 41 as a means for spraying the solid particles 29 may be placed or plural nozzles may be placed in the spraying means. In this case, spraying may be uniformly carried out with respect to the width direction (with respect to a direction of movement E of the fiber sheet 80') of the fiber 80 or fiber sheet 80'. Further, the ejecting opening of the nozzle 41 may be a slit and the tip of the nozzle 41 may be expanded to the width of the fiber sheet 80'. Furthermore, the spraying means may be reciprocated in parallel with the width direction of the fiber sheet 80' and in a direction crossing at a right angle or an appropriate angle to the direction of movement E of the fiber sheet 80'. In this case, the whole of the fiber sheet 80' may be treated by a minimum of nozzles 41 as a spraying means.

In the embodiments shown in FIGS. 2 and 3, the solid particles 29 sprayed as a mixed air stream from the nozzle 41 are sprayed onto the fiber surface of the fiber 80 or fiber sheet 80' movably supported by rollers 70 as a fiber-supporting means or rollers 70' as a fiber sheet-supporting means. The supporting means is not particularly limited, so long as the spraying with the solid particles may be carried out. As a preferable means, there may be mentioned, for example, a tenter apparatus placed before and after the area where the treatment by spraying with the solid particles is carried out and capable of moving the fiber or fiber sheet by clipping both sides thereof with pins or clips, a pair of rollers capable of sandwiching and supporting the fiber or fiber sheet, or a supporting net (such as a conveyer net) capable of spraying the fiber or fiber sheet placed thereon.

[3] Fiber Carrying Solid Particles and Fiber Sheet Carrying Solid Particles of the Present Invention The fiber carrying solid particles of the present invention is a fiber having at least a surface comprised mainly of a thermoplastic resin and carrying solid particles affixed to the surface, wherein a melting point or a decomposition point of the solid particles is higher than a melting point of the thermoplastic resin, an average particle size of the solid particles is equal to or less than ⅓ of an average diameter of the fiber, and a percentage of an exposed surface area obtained by a BET method (Se) of the solid particles carried on the fiber surface with respect to a total surface area obtained by a BET method (Sp) of the solid particles before being carried on the fiber surface, a rate of an effective surface [(Se/Sp)×100], is 50% or more.

The fiber carrying solid particles of the present invention may be manufactured by, for example, the process of the present invention for manufacturing a fiber carrying solid particles.

The fiber carrying solid particles of the present invention is a fiber having at least a surface comprised mainly of a thermoplastic resin and carrying solid particles affixed to the surface. With respect to the "fiber having at least a surface comprised mainly of a thermoplastic resin", the descriptions thereof previously mentioned in the manufacturing process of the present invention may be applied. That is, the fiber is not particularly limited, so long as it is a fiber having at least a surface comprised mainly of a thermoplastic resin and a surface able to be melted by heating (for example, heating at 50° C. or more, particularly 80° C. or more). As the fiber, there may be mentioned, for example, a synthetic fiber obtained by a melt spinning as a conventional method for manufacturing a fiber, a fiber obtained by a spun-bonding method, a melt-blown method, or a flush-spinning method as a conventional method for manufacturing a nonwoven fabric, or a fiber having a core component of a natural fiber or an inorganic fiber.

As the solid particles carried on the fiber carrying solid particles of the present invention, the solid particle used in the manufacturing process of the present invention may be used, except for the average particle size thereof.

The average particle size of the solid particle carried on the fiber carrying solid particles of the present invention must be equal to or less than ⅓ of the fiber diameter. When the average particle size of the solid particle is larger than ⅓ of the fiber diameter, the solid particles are liable to drop from the fiber surface, and thus it is difficult to maintain the state wherein the solid particles are affixed to the fiber surface. Further, it is difficult to affix the solid particles to the fiber surface when manufacturing the fiber carrying solid particles. The term "average particle size of the solid particle" as used herein means a number average particle size of the solid particle.

The rate of an effective surface (Ep) of the solid particles in the fiber carrying solid particles of the present invention is 50% or more, calculated in accordance with specific surface areas measured by a BET (BRUNAUER EMMETT TELLER) method. The rate of an effective surface means a percentage of an exposed surface area obtained by a BET method (Se) of the solid particles carried on the fiber surface with respect to a total surface area obtained by a BET method (Sp) of the solid particles before being carried on the fiber surface (Se/Sp). When the rate of an effective surface is 50% or more, the surface of the solid particle is effectively maintained when carried on the fiber surface, so that the surface function of the solid particle may be effectively exerted. On the contrary, when the rate of an effective surface is less than 50%, the surface of the solid particle is not effectively maintained when carried on the fiber surface, so that the surface function of the solid particle may mot be effectively exerted.

The BET method is a theoretical equation obtained by extending a monomolecular adsorption layer in a Langmuir method to a multimolecular adsorption layer. It is assumed that molecules are stacked and infinitely adsorbed. Herein, the specific surface areas may be calculated from an adsorption isotherm of a nitrogen gas or a krypton gas at −195.8° C. (a boiling point of liquid nitrogen).

The rate of an effective surface Ep (%) may be calculated as described below. It is assumed that the surface area of a fiber before carrying the particles is the same as that after they are carried. In this calculation, as a mass of the solid particle or the fiber carrying solid particles, a converted mass W (g/g) per 1 g of a fiber mass is used.

$$Ep = (Se/Sp) \times 100$$
$$= (Sc - Sf)/Sp \times 100$$

Ep: rate of an effective surface of the solid particles (%)

Se: exposed surface area obtained by a BET method of the solid particles

Sp: total surface area obtained by a BET method of the solid particles

Sc: surface area obtained by a BET method of the fiber carrying solid particles

Sf: surface area obtained by a BET method of the fiber before carrying solid particles $$Sc = Soc \times Wc$$

Soc: specific surface area obtained by a BET method of the fiber carrying solid particles ($m^2/g$)

Wc: mass of the fiber carrying solid particles derived from 1 g of fiber (g/g) [i.e., mass of the fiber carrying solid particles per 1 g of fiber (g/g)]

$$Sf = Sof \times Wf$$

Sof: specific surface area obtained by a BET method of the fiber ($m^2/g$)

Wf: mass of the fiber derived from 1 g of fiber (g/g) [i.e., mass of the fiber per 1 g of fiber (g/g)]=1 (g/g)

$$Sp = Sop \times Wp$$

Sop: specific surface area obtained by a BET method of the total solid particles ($m^2/g$)

Wp: mass of the solid particles carried on 1 g of fiber (g/g) [i.e., mass of the solid particles per 1 g of fiber (g/g))]=(Wc−1) (g/g)

Further, in the calculation of the specific surface area of the fiber, if the fiber is not porous and a value of fiber diameter/fiber length is equal to or less than 0.01, a cross-sectional area of the fiber may be substantially neglected. In this case, instead of the specific surface area of the fiber obtained by a BET method, a specific surface area of the fiber may be calculated from a relation between a lateral area of the fiber and a density of the fiber material, for example, described below.

$$Sof = \{2\pi \times (Rf/2) \times Lf\}/\{\pi \times (Rf/2)^2 \times Lf \times Df\}$$
$$= 4/(Rf \times Df)$$

Lf: fiber length

Rf: average diameter of the fiber

Df: density of the fiber material

In the fiber carrying solid particles of the present invention, a retention rate of the solid particles after a washing test for retention is preferably 80% or more, more preferably 90% or more. That is, when the fiber carrying solid particles or the fiber sheet carrying solid particles is used under a condition that a dropping of the solid particles causes a problem, it is preferable that 80% or more (more particularly 90% or more) of the solid particles affixed to the fiber surface are maintained after a washing test for retention. When the retention rate of the solid particles is equal to or less than 80%, the solid particles drop from the fiber, and thus will sometimes damage a human body by aspirating the solid particles. Further, for example, as a filter, when the fiber or fiber sheet is brought into contact with an air stream, dust derived from the carried solid particles is generated from the fiber or fiber sheet. Furthermore, when using as an abradant carrying abrasive particles on the,fiber or fiber sheet, if the solid particles are not strongly attached, an abrasive action is low and an adequate abrasive action is not obtained. For these uses, it is preferable that the retention rate of the solid particles is 80% or more.

Herein, the washing test for retention of the fiber carrying solid particles may be carried out, for example, as described below.

More particularly, the fiber carrying solid particles is cut into a fiber length of approximately 10 cm, and then 100 to 300 of fibers are arranged and clipped at both end thereof to obtain a fiber bundle. As an article to be tested, the fiber bundle is placed into a net (10 cm×10 cm) for washing. If the fiber carrying solid particles has a length of 10 cm or less, as an article to be tested, a mass of fibers corresponding to a fiber having a length of 10 to 30 m is placed into a net having meshes such that fibers may not pass therethrough.

Into a washing machine, 40 liters of water at approximately 40° C. are poured, and then, 20 g of a laundry detergent is added and dissolved by mixing. One of an article to be tested and appropriate pieces of cotton cloth are placed in the washing solution, so that a bath ratio is 40:1, and then washing is carried out. Washing by unidirectionally rotating for 15 minutes, rinsing with water for 15 minutes, and dehydration in a dehydrator for 3 minutes is carried out. The article to be tested is taken from the dehydrator, and allowed to stand at room temperature. After drying, a mass of the dried article to be tested is measured and compared to that before washing. A degree of dropping of the carried,solid particles is calculated, and then the retention rate of the solid particles is determined from a mass of the resulting solid particles.

The fiber carrying solid particles may be manufactured by, for example, the process of the present invention of manufacturing a fiber carrying solid particles wherein solid particles having an average particle size equal to or less than ⅓ of an average diameter of the fiber are used as the solid particle.

The fiber sheet carrying solid particles of the present invention is not particularly limited, so long as at least the fibers carrying solid particles of the present invention are contained in the fiber sheet. The fiber sheet carrying solid particles of the present invention may comprising mainly of the fiber carrying solid particles of the present invention, or may comprise one or more fibers other than the fiber carrying solid particles of the present invention. The fiber other than the fiber carrying solid particles is not particularly limited, but may be, for example, a fiber having at least a surface comprised mainly of a thermoplastic resin, a fiber whose surface is not a thermoplastic resin (such as an inorganic fiber), or a fiber not having a melting point, but having a decomposition point.

As a structure of the fiber sheet, there may be mentioned, for example, a woven fabric, a knitted fabric, a nonwoven fabric, or a composite fabric thereof. The woven fabric or knitted fabric may be obtained by processing the fibers using a loom or a knitting machine. The nonwoven fabric may be obtained by, for example, a dry-laid method, a spun-bonding method, a melt-blown method, a flush-spinning method, or a wet-laid method as a conventional method for manufacturing a nonwoven fabric. Further, a fiber sheet wherein fibers are bonded to each other may be obtained by mixing the fiber web formed by these methods with, for example, an adhesive fiber and/or a composite fiber consisting of two or more resins different from each other with respect to a melting point, and heating the mixture. Furthermore, a fiber sheet wherein fibers are entangled may be obtained by an action for mechanically entangling (such as hydroentanglement or needle punching) the fiber webs to each other. A fiber sheet wherein fibers are partially bonded may be obtained by passing the fiber web between a heated embossing roll and a heated smoothing roll. An integrated fiber sheet may be obtained by laminating the different fiber sheets.

As a method for obtaining the fiber sheet carrying solid particles of the present invention, for example, a fiber sheet containing the fiber carrying solid particles of the present invention may be manufactured in accordance with these above-mentioned methods. Further, a fiber sheet not containing the fiber carrying solid particles of the present invention may be formed, and then the solid particles may be carried on the sheet by the process for manufacturing a fiber sheet carrying solid particles of the present invention. Because, the fiber sheet carrying solid particles of the present invention contains fibers carrying solid particles in the fiber sheet, the function of the solid particles carried on the fibers carrying solid particles may be more effectively exerted by using the fiber sheet as, for example, a filter material, an absorbent material, or a covering material.

The washing test for retention of the fiber sheet carrying solid particles of the present invention may be carried out, for example, as described below.

Into a washing machine, 40 liters of water at approximately 40° C. are poured, and then 20 g of a laundry detergent is added and dissolved by mixing. One of an article to be tested and appropriate pieces of cotton cloth are placed in the washing solution, so that a bath ratio is 40:1, and then washing is carried out. Washing by unidirectionally rotating for 15 minutes, rinsing with water for 15 minutes, and dehydration in a dehydrator for 3 minutes is carried out. The article to be tested is taken from the dehydrator, and allowed to stand at room temperature. After drying, a mass of the dried article to be tested is measured and compared to that before washing. A degree of dropping of the carried solid particles is calculated, and then the retention rate of the solid particles is determined from a mass of the resulting solid particles.

EXAMPLES

The present invention now will be further illustrated by, but is by no means limited to, the following Examples.

Example 1

A wet-laid sheet was prepared from 100% core-sheath type composite fibers (fineness=2.2 decitex; fiber length=10 mm) consisting of a polypropylene resin as a core component and a high-density polyethylene resin (melting point=132° C.) as a sheath component by means of a wet-laying apparatus. Then, the wet-laid sheet was mounted on a belt conveyor of a wire cloth, and bonded by heating at 140° C. in an air-through type drier so that the high-density polyethylene resins as an adhesive component in the composite fiber were melted. Thus, a wet-laid nonwoven fabric having an area density of 52.83 g/m$^2$ was obtained.

Subsequently, about 100 g of titanium oxide particles wherein a particle size of the primary particles was about 20 nm, and a particle size of the secondary particles was about 0.1 to 1 μm were charged into a dish having an inside diameter of 20 cm, and heated at 135° C. Then, the wet-laid nonwoven fabric (10 cm×10 cm; a mass of fibers=0.5283 g) was charged into the dish, and the dish was capped. The capped dish was shaken by hand 5 times upward and downward. A resulting fiber sheet carrying affixed titanium oxide particles was quickly taken out and washed with water, to remove unaffixed titanium oxide particles, and obtain a fiber sheet carrying solid particles and consisting of fibers carrying solid particles wherein titanium oxide particles were uniformly carried on surfaces of the fibers.

A mass of the fiber sheet carrying solid particles was 0.5926 g, and a mass of the fibers carrying solid particles per 1 g of the fiber mass was 1.122 g/g (=0.5926 g/0.5283 g). A mass of the solid particles carried on the fibers was 0.0643 g(=0.5926 g−0.5283 g). A mass of the titanium oxide particles carried on the fibers having the fiber mass of 1 g was 0.1217 g/g (0.0643 g/0.5283 g).

A specific surface area of the fibers carrying the solid particles was measured by a BET method and found to be 7.27 m$^2$/g. A specific surface area of the fibers in the nonwoven fabric before titanium oxide particles were affixed was 0.3329 m$^2$/g, and a specific surface area of the titanium oxide particles before being affixed to the fibers, i.e., a specific surface area of the inherent titanium oxide particles, was 89.59 m$^2$/g. From these values, an effective surface rate of the specific surface area of the titanium oxide particles on the fibers carrying the solid particles was calculated with respect to the specific surface area of the inherent titanium oxide particles and found to be 71.8%. Further, no shrinkage or cleavage of the fibers in the fiber sheet carrying the solid particles was observed during and/or after the treatment for fixing the titanium oxide particles to the fiber surfaces.

A test of a washing resistance was carried out so as to evaluate the degree of adherence of the titanium oxide particles to the fiber sheet carrying the solid particles. The test revealed that 6.43 g/m$^2$ of titanium oxide particles were carried on the fiber sheet before the test of a wash resistance and 6.24 g/m$^2$ of titanium oxide particles retained after the test of a wash resistance, and thus the rate of holding the solid particles was 97.0%.

Example 2

A wet-laid sheet was prepared from 100% high-density polyethylene fibers (fineness=2.2 decitex, fiber length=10 mm, melting point=132° C.) by a wet-laying apparatus, and fibers were hydroentangled. The resulting wet-laid sheet was mounted on a belt conveyor of a wire cloth, and dried at 125° C. in an air-through type drier to obtain a wet-laid nonwoven fabric.

Subsequently, the procedure of Example 1 was repeated to obtain a fiber sheet carrying solid particles and consisting of fibers carrying solid particles wherein titanium oxide particles were uniformly carried on surfaces of the fibers.

An area density of the wet-laid nonwoven fabric, i.e., the wet-laid nonwoven fabric before the titanium oxide particles were affixed thereto, was 51.21 g/m$^2$ (a fiber mass=0.5121 g). A mass of the fiber sheet carrying solid particles was 0.5767 g, and a mass of the fibers carrying solid particles per 1 g of the fiber mass was 1.126 g/g (=0.5767 g/0.5121 g). A mass of the solid particles carried on the fibers was 0.0646 g. A mass of the titanium oxide particles carried on the fibers having the fiber mass of 1 g was 0.1261 g/g (0.0646 g/0.5121 g)

A specific surface area of the fibers carrying the solid particles was measured by a BET method and found to be 7.15 m$^2$/g. A specific surface area of the fibers in the nonwoven fabric before titanium oxide particles were affixed was 0.3242 m$^2$/g, and a specific surface area of the titanium oxide particles before being affixed to the fibers, i.e., a specific surface area of the inherent titanium oxide particles, was 89.59 m$^2$/g. From these values, an effective surface rate of the specific surface area of the titanium oxide particles on the fibers carrying the solid particles was calculated with respect to the specific surface area of the inherent titanium oxide particles and found to be 68.4%. Further, no shrinkage or cleavage of the fibers in the fiber sheet carrying the solid particles was observed during and/or after the treatment for fixing the titanium oxide particles to the fiber surfaces.

A test of a washing resistance was carried out so as to evaluate the degree of adherence of the titanium oxide particles to the fiber sheet carrying the solid particles. The test revealed that 6.46 g/m$^2$ of titanium oxide particles were carried on the fiber sheet before the test of a wash resistance and 6.35 g/m$^2$ of titanium oxide particles retained after the test of a wash resistance, and thus the rate of holding the solid particles was 98.3%.

Example 3

Calcium carbonate particles (particle size=5 μm) heated at 130° C. were sprayed onto monofilaments (fineness=20 decitex) made of high-density polyethylene resin (melting point=130° C.) to obtain monofilaments carrying solid particles wherein calcium carbonate particles were uniformly carried on the fiber surfaces. No shrinkage or cleavage of the monofilaments carrying the solid particles was observed during and/or after the treatment for fixing the calcium carbonate particles to the fiber surfaces.

Comparative Example 1

The procedure of Example 1 was repeated to obtain a wet-laid nonwoven fabric having an area density of 51.47 g/m$^2$.

Subsequently, about 100 g of titanium oxide particles wherein a particle size of the primary particles was about 20 nm, and a particle size of the secondary particles was about 0.1 to 1 μm were charged into a dish having an inside diameter of 20 cm, and maintained at 25° C. Then, the wet-laid nonwoven fabric (10 cm×10 cm; a mass of fibers=0.5147 g) was charged into the dish, and the dish was capped. The capped dish was handshaken 5 times upward and downward. Then, the dish was charged into a drier at 135° C. After 5 minutes, the dish was taken out of the drier. The fiber sheet was quickly taken from the dish, and washed with water to remove unaffixed titanium oxide particles and obtain a fiber sheet carrying solid particles.

In the fiber sheet obtained in Comparative Example 1, titanium oxide particles were not uniformly carried on the fiber surfaces, and some aggregations of the solid particles were observed on the fiber surface.

A mass of the fiber sheet carrying solid particles was 0.5796 g, and a mass of the fibers carrying solid particles per 1 g of the fiber mass was 1.126 g/g (=0.5796 g/0.5147 g). A mass of the titanium, oxide particles carried on the fibers was 0.0649 g. A mass of the titanium oxide particles carried on the fibers having the fiber mass of 1 g was 0.1261 g/g (0.0649 g/0.5174 g)

A specific surface area of the fibers carrying the solid particles was measured by a BET method and found to be 3.73 m$^2$/g. A specific surface area of the fibers in the nonwoven fabric before titanium oxide particles were affixed was 0.3329 m$^2$/g, and a specific surface area of the titanium oxide particles before being affixed to the fibers, i.e., a specific surface area of the inherent titanium oxide particles, was 89.59 m$^2$/g. From these values, an effective surface rate of the specific surface area of the titanium oxide particles on the fibers carrying the solid particles was calculated with respect to the specific surface area of the inherent titanium oxide particles and found to be 34.2%. Further, no cleavage of the fibers in the fiber sheet carrying the solid particles was observed, but shrinkage was observed during and/or after the treatment for fixing the titanium oxide particles to the fiber surfaces.

A test of a washing resistance was carried out so as to evaluate the degree of adherence of the titanium oxide particles to the fiber sheet carrying the solid particles. The test revealed that 6.49 g/m$^2$ of titanium oxide particles were carried on the fiber sheet before the test of a wash resistance and 6.25 g/m$^2$ of titanium oxide particles retained after the test of a wash resistance, and thus the rate of holding the solid particles was 96.3%.

Comparative Example 2

A wet-laid sheet was prepared from 100% high-density polyethylene fibers (fineness=2.2 decitex, fiber length=10 mm, melting point=132° C.) by a wet-laying apparatus, and fibers were hydroentangled. The resulting wet-laid sheet was mounted on a belt conveyor of a wire cloth, and dried at 125° C. in an air-through type drier to obtain a wet-laid nonwoven fabric having an area density of 51.21 g.

Subsequently, the procedure of Comparative Example 1 was repeated to obtain a fiber sheet carrying titanium oxide particles. A resulting fiber sheet carrying the solid particles had uneven distribution of the titanium oxide particles on the fiber surfaces, and some aggregations of the solid particles were observed on the fiber surface. Further, for the resulting fiber sheet carrying the solid particles, shrinkages and many cleavages of the fibers in the nonwoven fabric carrying the solid particles were observed during and/or after the treatment for fixing the titanium oxide particles to the fiber surfaces.

Comparative Example 3

Calcium carbonate particles (particle size=5 μm) at an ordinary temperature were sprayed onto and brought into contact with monofilaments (fineness=20 decitex) made of high-density polyethylene resin (melting point=130° C.). Then, the whole was charged into a drier at 135° C. for 1 minute. Monofilaments were shrunk and cleaved, and monofilaments carrying solid particles were not obtained.

Results of Evaluation

The results of Examples 1 to 2 and Comparative Example 1 are shown in Table 1. In Examples 1 to 2, an effective surface rate of the solid particles was more than 50%. This means that the solid particles can exhibit their surface functions inherent to the solid particles, after being affixed to the fiber surfaces. In Comparative Example 1, on the contrary, an effective surface rate of the solid particles was less than 50%. This means that the solid particles cannot sufficiently exhibit the surface functions inherent to the solid particles, after being affixed to the fiber surfaces.

In Examples 1 to 3, no shrinkage or cleavage of the fibers was observed when the solid particles were mounted on the fiber surfaces. On the contrary, in Comparative Examples 1 to 3, shrinkage and cleavage of the fibers was observed. Further, the tests of a washing resistance show that the solid particles are not largely dropped from the resulting sheets in Examples 1 to 2 as occurred in the sheet of Comparative Example 1. This means that the solid particles are firmly affixed to the fibers.

TABLE 1

| | Example 1 | Example 2 | Comparative Example 1 |
|---|---|---|---|
| Fiber sheet carrying solid particles | | | |
| Specific surface areas by a BET method: Soc ($m^2/g$) | 7.27 | 7.15 | 3.73 |
| Mass (converted): Wc (g/g) | 1.122 | 1.126 | 1.126 |
| Sc = Soc x Wc | 8.157 | 8.051 | 4.200 |
| Fiber sheet | | | |
| Specific surface areas by a BET method: Sof ($m^2/g$) | 0.3329 | 0.3242 | 0.3329 |
| Sf = Sof | 0.3329 | 0.3242 | 0.3329 |
| Solid particles | | | |
| Specific surface areas by a BET method: Sop ($m^2/g$) | 89.59 | 89.59 | 89.59 |
| Mass (converted): Wp (g/g) | 0.1217 | 0.1261 | 0.1261 |
| Sp = Sop x Wp | 10.90 | 11.30 | 11.29 |
| Rate of an effective surface (%) | | | |
| Ep = (Sc-Sf)/Sp x 100 | 71.8 | 68.4 | 34.2 |
| Washing test for retention | | | |
| Amount of retention of solid particles ($g/m^2$) | 6.24 | 6.35 | 6.25 |
| Retention rate of solid particles (%) | 97.0 | 98.3 | 96.3 |

According to the manufacturing process or manufacturing apparatus of the present invention, the solid particles may be uniformly affixed to the fiber surface of the fiber or the fiber surface of the fibers forming the fiber sheet, and the surface properties of the solid particle are effectively maintained.

According to the manufacturing process or manufacturing apparatus of the present invention, the heated solid particles are brought into contact with the fiber surface, and thus the solid particles are carried by melting only contact portions of the fiber surface between the solid particles and the fiber surface. As a result, a surface portion other than the contact portions or affixed portions in the surface of the solid particles is rarely covered with a molten resin. Further, the whole resin on the fiber surface is rarely melted and made fluid, and thus the solid particles are rarely buried.

A molten resin is rarely leaked from gaps between the solid particles and the fiber surface. Therefore, a problem that the solid particles are partially stacked by affixing other solid particles on the outside of each of the solid particles and are not uniformly carried on the fiber surface, does not occur. Further, the solid particles may be affixed to or carried on the fiber surface as a uniform monolayer.

According to the manufacturing process or manufacturing apparatus of the present invention, because the solid particles melt only the fiber surface, if a fiber consisting of one resin component is treated, a problem that the fiber is shrunk, melted as a whole, or broken during a treatment for contact or affixation does not occur. Further, the solid particles are strongly affixed and carried on the fiber surface by cooling after contact, and thus the solid particles are not easily removed from the fiber surface by, for example, a washing test for retention.

In the manufacturing process or manufacturing apparatus of the present invention, when using the method for spraying an air stream containing the heated solid particles onto the surface of the fiber or the fiber sheet as a method for bringing the heated solid particles into contact with the fiber or the fiber sheet, the air stream containing the heated solid particles is sprayed onto the fiber surface. As a result, the solid particles are brought into contact with the fiber surface by an inertial force of the solid particles, and thus the solid particles may be strongly affixed to the fiber surface.

In the fiber carrying solid particles of the present invention, a surface portion other than the portions carried in the surface of the solid particle is not covered by a molten resin, and the solid particles are not buried in the molten resin, in addition the solid particles are uniformly carried on the fiber surface. Therefore, the rate of an effective surface of the solid particles is 50% or more, obtained by calculating in accordance with specific surface areas measured by a BET method. That is, according to the fiber carrying solid particles of the present invention, the surface function of the solid particle may be effectively exerted, even under a condition that the solid particles are carried on the fiber surface.

The fiber sheet carrying solid particles of the present invention contains the fibers carrying solid particles. Therefore, the function of the solid particles carried on the fibers carrying solid particles may be more effectively exerted by using the fiber sheet as, for example, a filter material, an absorbent material, or a covering material.

As above, the present invention was explained with reference to particular embodiments, but modifications and improvements obvious to those skilled in the art are included in the scope of the present invention.

The invention claimed is:

1. A fiber having at least a surface comprised mainly of a thermoplastic resin and carrying solid particles affixed to the surface, wherein a melting point or a decomposition point of the solid particle is higher than a melting point of the thermoplastic resin, an average particle size of the solid particle is equal to or less than ⅓ of an average diameter of the fiber, a percentage of an exposed surface area obtained by a BET method (Se) of the solid particles carried on the fiber surface with respect to a total surface area obtained by a BET method (Sp) of the solid particles before being carried on the fiber surface, a rate of an effective surface [(Se/Sp)× 100], is 50% or more, and the fiber is a synthetic fiber consisting of one thermoplastic resin.

2. The fiber carrying solid particles according to claim 1, wherein a retention rate of the solid particles after a washing test for retention is 80% or more.

3. A fiber sheet, comprising the fibers carrying solid particles of claim 2.

4. The fiber sheet according to claim 3, wherein the fiber sheet is a nonwoven fabric.

5. A fiber sheet, comprising the fibers carrying solid particles of claim 1.

6. The fiber sheet according to claim 5, wherein the fiber sheet is a nonwoven fabric.

7. A fiber sheet, comprising fibers having at least a surface comprised mainly of a thermoplastic resin and carrying solid particles affixed to the surface, wherein a melting point or a decomposition point of the solid particle is higher than a melting point of the thermoplastic resin, an average particle size of the solid particle is equal to or less than ⅓ of an average diameter of the fiber, a percentage of an exposed surface area obtained by a BET method (Se) of the solid particles carried on the fiber surface with respect to a total surface area obtained by a BET method (Sp) of the solid particles before being carried on the fiber surface, a rate of an effective surface [(Se/Sp) ×100], is 50% or more, the fiber sheet is a nonwoven fabric, and the solid particles are carried on the nonwoven fabric in which fibers are bonded to each other by a heat treatment.

8. The fiber sheet according to claim 7, wherein a retention rate of the solid particles after a washing test for retention is 80% or more.

9. The fiber sheet according to claim 8, wherein the fiber is a synthetic fiber consisting of one thermoplastic resin.

10. The fiber sheet according to claim 7, wherein the fiber is a synthetic fiber consisting of one thermoplastic resin.

11. A fiber sheet, comprising fibers having at least a surface comprised mainly of a thermoplastic resin and carrying solid particles affixed to the surface, wherein a melting point or a decomposition point of the solid particle is higher than a melting point of the thermoplastic resin, an average particle size of the solid particle is equal to or less than ⅓ of an average diameter of the fiber, a percentage of an exposed surface area obtained by a BET method (Se) of the solid particles carried on the fiber surface with respect to a total surface area obtained by a BET method (Sp) of the solid particles before being carried on the fiber surface, a rate of an effective surface [(Se/Sp)×100], is 50% or more, the fiber sheet is a nonwoven fabric, and the solid particles are carried on the nonwoven fabric in which fibers are mechanically entangled to each other.

12. The fiber sheet according to claim 11, wherein a retention rate of the solid particles after a washing test for retention is 80% or more.

13. The fiber sheet according to claim 12, wherein the fiber is a synthetic fiber consisting of one thermoplastic resin.

14. The fiber sheet according to claim 11, wherein the fiber is a synthetic fiber consisting of one thermoplastic resin.

15. A fiber sheet, comprising fibers having at least a surface comprised mainly of a thermoplastic resin and carrying solid particles affixed to the surface, wherein a melting point or a decomposition point of the solid particle is higher than a melting point of the thermoplastic resin, an average particle size of the solid particle is equal to or less than ⅓ of an average diameter of the fiber, a percentage of an exposed surface area obtained by a BET method (Se) of the solid particles carried on the fiber surface with respect to a total surface area obtained by a BET method (Sp) of the solid particles before being carried on the fiber surface, a rate of an effective surface [(Se/Sp) ×100], is 50% or more, the fiber sheet is a nonwoven fabric, and the solid particles are carried on the nonwoven fabric in which fibers are partially bonded to each other.

16. The fiber sheet according to claim 15, wherein a retention rate of the solid particles after a washing test for retention is 80% or more.

17. The fiber sheet according to claim 16, wherein the fiber is a synthetic fiber consisting of one thermoplastic resin.

18. The fiber sheet according to claim 15, wherein the fiber is a synthetic fiber consisting of one thermoplastic resin.

* * * * *